United States Patent [19]

Terrian

[11] Patent Number: 4,686,792

[45] Date of Patent: Aug. 18, 1987

[54] COMBINATION STORM WINDOW AND SECURITY SYSTEM

[76] Inventor: Barbara C. Terrian, 370 Coogan Way, El Cajon, Calif. 92020

[21] Appl. No.: 835,168

[22] Filed: Mar. 3, 1986

[51] Int. Cl.[4] ..... E04B 65/04

[52] U.S. Cl. ..... 49/61; 49/13; 116/85; 200/61.62

[58] Field of Search ..... 49/61, 62, 13, 31; 52/202, 203, 207; 116/85; 200/61.62

[56] References Cited

U.S. PATENT DOCUMENTS

| | | | |
|---|---|---|---|
| 2,663,917 | 12/1953 | Peterson | 49/61 X |
| 3,706,090 | 12/1972 | Callaghan | 49/13 X |
| 3,992,815 | 11/1976 | Potter | 49/62 |
| 4,121,379 | 10/1978 | Everson | 52/202 X |
| 4,215,517 | 8/1980 | Everson | 49/61 X |
| 4,407,099 | 10/1983 | McLaughlin | 52/202 |
| 4,409,758 | 10/1983 | Dickerson et al. | 49/62 X |
| 4,473,980 | 10/1984 | Foster | 49/62 X |
| 4,561,223 | 12/1985 | Gold et al. | 52/202 |

*Primary Examiner*—Philip C. Kannan
*Attorney, Agent, or Firm*—Charles C. Logan, II

[57] ABSTRACT

A combination storm window and security system that fits into the window frame openings of a house. The window frame is normally formed of aluminum material and it has a stationary window panel and a slidable window panel. A pair of vertical sheet metal brackets are spaced inwardly from the aluminum window frame and these metal brackets are rigidly attached to the respective vertically extending window frame side members. Spaced intermediate the metal brackets is a vertical support member having its bottom end rigidly attached to the window sill and its top end rigidly attached to the header. A pair of storm windows have elongated strip magnets attached to their outside surface that are detachably securable to the respective vertical sheet metal brackets. The vertical support member may be formed of sheet metal or a vertically oriented metal plate may be attached to its inner surface for detachably contacting the strip magnets on the outside surface of the storm window panels. The interior surfaces of the storm window panels have a channel formed along their bottom edge that functions to provide a fingergrip flange for removing the storm panels and it also functions to house one component of a wide gap magnetic switch whose other component is mounted adjacent thereto in one of the vertical window frame members. The second component of the wide gap magnetic switch is connected to a transmitter in a security alarm system. The gap between the two components of the wide gap magnet is such that anyone attempting to remove the storm window panel will cause a signal to be transmitted to the transmitter indicating that someone is trying to break into the house.

3 Claims, 5 Drawing Figures

COMBINATION STORM WINDOW AND SECURITY SYSTEM

BACKGROUND OF THE INVENTION

The invention relates to storm windows and more specifically to storm windows which have structure associated with them that are incorporated into a security system for detecting attempts to enter through the windows of the house.

In the past the use of storm windows for eliminating heat loss through the windows of a home have been widespread. Also there are numerous security systems that attempt to recognize attempts to enter the house through the windows.

Some of the security systems use an electrical wire in a tape that is adhered to the surface of the window pane and which is connected to an alarm system that is set off when the window is broken. This has not proven entirely satisfactory since portions of the window can be cut away without disturbing the electrical circuit in the tape and which therefore does not activate the alarm system.

Of course the main deterent to having someone enter the windows of the house is to have windows locked. This again is not successful where the intruder breaks the window pane to gain entry.

It is an object of the invention to provide a novel combination storm window and security system that provides the home owner with structure for cutting down on his heating and air conditioning bills.

It is also an object of the invention to provide a novel combination storm window and security system that can not be circumvented by merely breaking the glass of the window pane of the storm window.

It is another object of the invention to provide a novel combination storm window and security system that utilizes storm windows whose window pane is virtually indestructable.

It is an additional object of the invention to provide a novel combination storm window and security system that virtually makes any attempts to enter through the window detectable therby setting off a security alarm system.

It is a further object of the invention to provide a novel storm window and security system that can be easily installed.

SUMMARY OF THE INVENTION

Applicant's novel combination storm window and security system can be used with windows having wooden or aluminum window frames. A pair of vertical sheet metal brackets are offset toward the interior side of the window frame opening from the window and these sheet metal brackets are rigidly attached to the respective vertically extending window frame opening members. If the width of the window frame opening is such that a pair of storm windows is desirable, a vertical support member is used and its bottom ends rigidly attached to the window sill and its top ends rigidly attached to the header. The vertical support member is positioned approximately midway between the vertical sheet metal brackets. A pair of storm windows whose window panes are formed of acrylic plastic material have elongated strip magnets attached to their vertical edges and these are detachably secured to the vertical sheet metal brackets and also to the inner surface of the vertical support member if one is used.

Adjacent the bottom edge of the storm windows is a horizontal channel having a flange that functions as a fingergrip for pulling the storm windows away from the vertical sheet metal brackets. Also mounted in this channel is one component of a wide gap magnetic switch and the other component of the wide gap magnetic switch is mounted adjacent thereto in the vertical window opening frame member. The second component of the wide gap magnetic switch is connected to a transmitter which is actuated when the two components of the wide gap magnet are pulled apart a predetermined distance. The transmitter signals an alarm such as a siren, or it may be connected to a telephone system for direct dialing the police department, etc.

One of the key features of the combination storm window and security system resides in the fact that the window pane of the storm windows is formed from acrylic plastic material. Thus these windows are virtually indestructible and any attempt by an intruder to break the window to gain entry will cause the storm window panel to be knocked away from its magnetically attached position which in turn causes the two components of the wide gap magnetic switch to be spaced apart to such a degree that the transmitter sets off the alarm. The channel along the bottom edge of the storm window panels provide a perfect support for the magnet component of the wide gap magnetic switch that is attached to the storm window. Also the acrylic window pane can not be cut as in the manner of glass for gaining entry through the window.

DESCRIPTION OF THE PREFERRED EMBODIMENT

Figure 1:
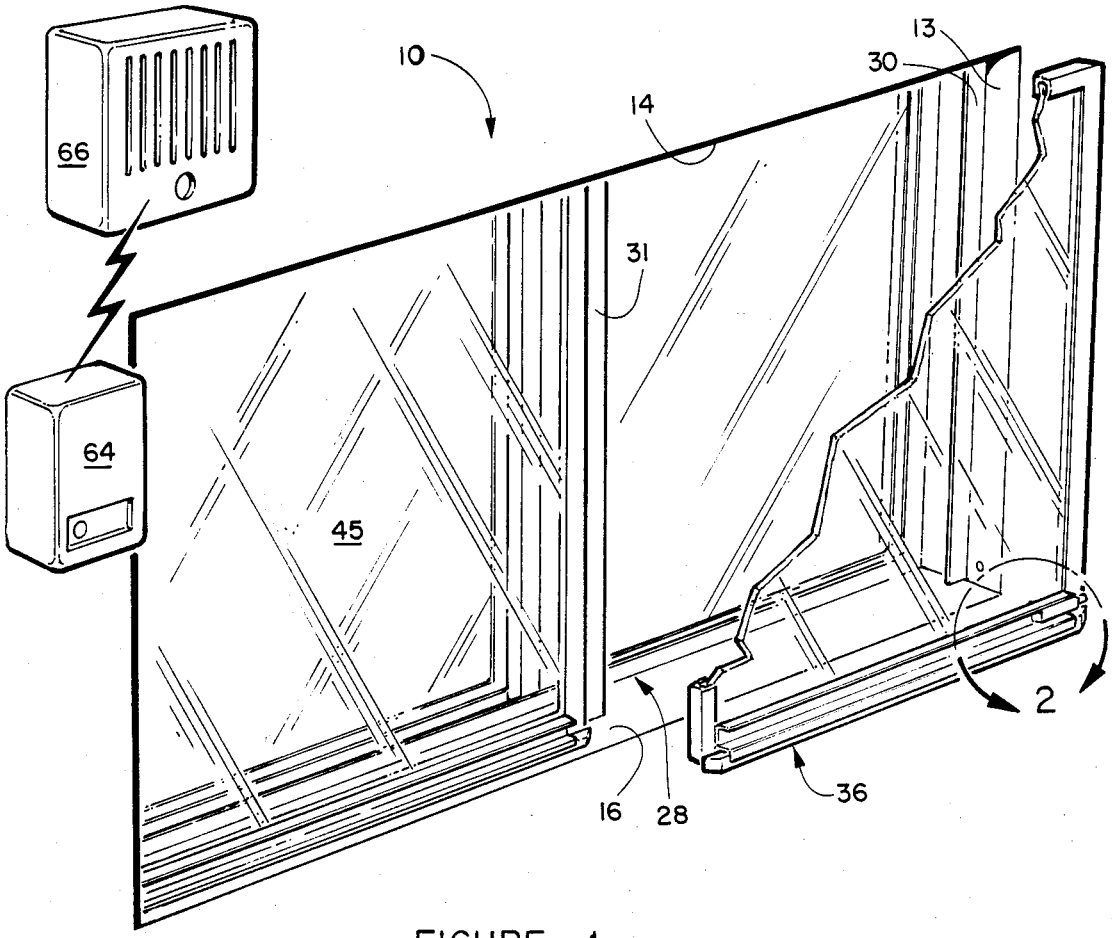
FIG. 1 is a perspective view illustrating the novel combination storm window and security system with portions broken away for clarity.
Figure 2:
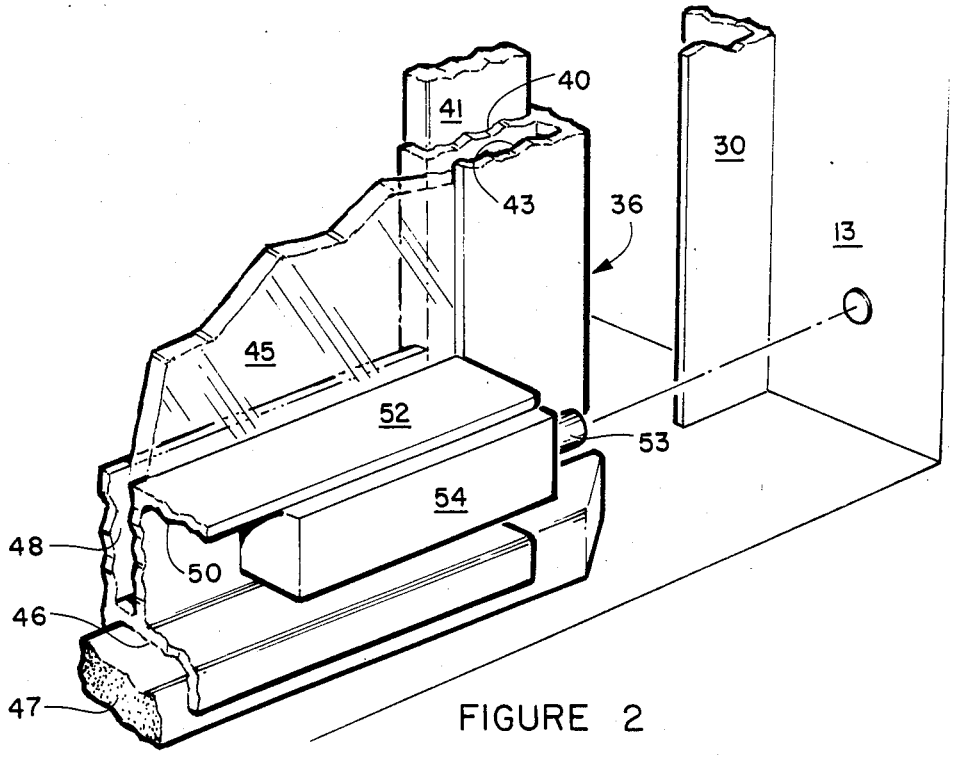
FIG. 2 is a perspective view taken along line 2 of Figure 1.
Figure 3:
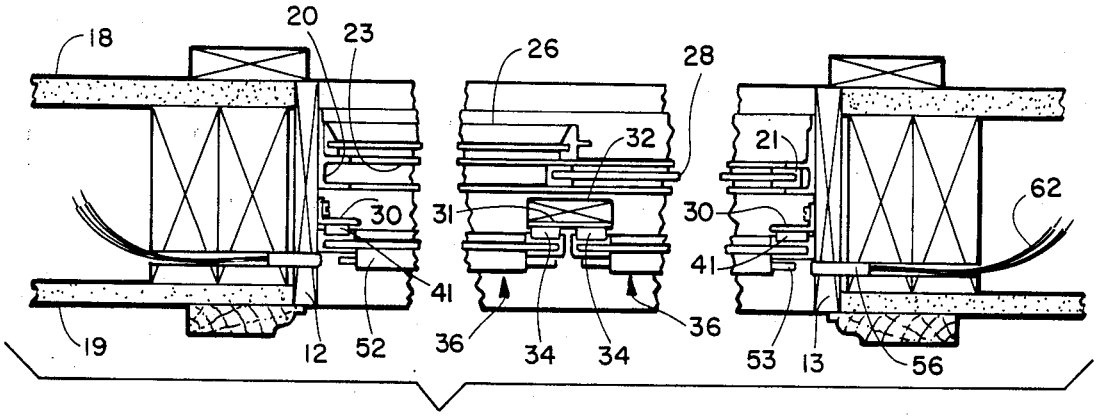
FIG. 3 is a schematic cross-sectional view of the construction of the house window frame opening and the window itself.
Figure 4:
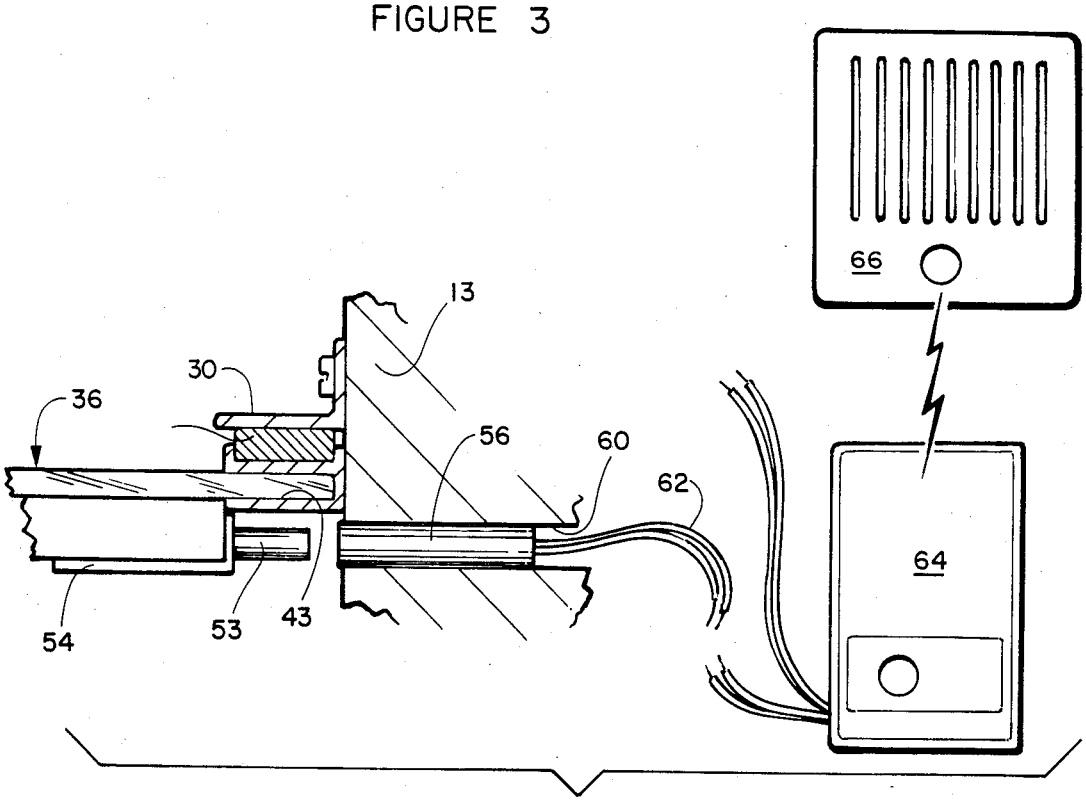
FIG. 4 is a schematic illustration of the wide gap magnetic switch and the manner in which it is mounted to the storm window.

Referring now to FIGS. 1-5 of the drawings, applicant's novel combination storm window and security system will now be described. The system is generally designated numeral 10.

The house window frame opening has a rectangular configuration formed from a pair of laterally spaced window frame members 12 and 13, a header 14, and a window sill 16. Exterior wall 18 and interior wall 19 form other parts of the construction.

A rectangularly shaped aluminum window frame is fixedly mounted in the window frame opening. It has a pair of laterally spaced vertical channels 20 and 21, and a horizontal track channel 23. The stationary window panel 26 is rigidly attached to the window frame and a slidable window panel 28 is mounted in horizontal track channel 23.

A pair of vertical sheet metal brackets 30 are offset toward the interior side of the window frame opening and these are rigidly attached to the respective vertically extending window frame members 12 and 13. A central vertical support member 32 is rigidly attached to the window sill at its bottom end and to the header at its top end. A metal plate 31 is attached to the inner surface of vertical support member 32. Elongated strip magnets 34 on the rear surface of the storm window 36 are detachably attached to the inside surface of metal plate 31.

The storm windows 36 have extruded molded sides. The vertical sides have a channel 40 formed in their rear surface that accommodates an elongated strip magnet 41. Channels 43 accommodate the lateral edges of an acrylic window pane 45. The bottom extruded molded frame member has a channel 46 in its bottom that receives a foam cushion 47. It also has a channel 48 that receives the bottom edge of acrylic window pane 45. A channel 50 is formed on the inner surface of the bottom molding piece and its flange 52 functions as a fingergrip member for removing the storm windows. The channel also provides a support housing for a magnetic support block 54 within which is mounted a cylindrical magnet 53 that along with magnetic switch 56 form a wide gap magnetic switch. Component 56 of the wide gap magnetic switch is mounted in a bore hole 60 in one of the vertical window frame members. Wires 62 extend from magnetic switch 56 to a transmitter 64. When the gap between the two components 53 and 56 becomes greater than a predetermined distance, a signal is transmitted from transmitter 64 to an alarm 66.

Figure 5:
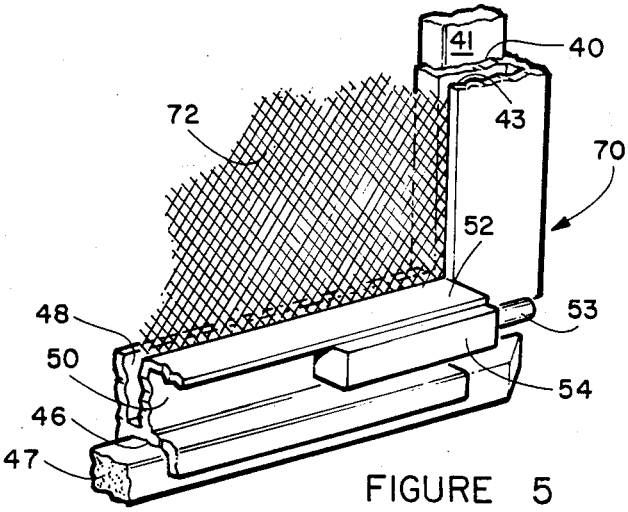
FIG. 5 is a partial perspective view of a screen panel having the same construction as the storm windows.

A screen panel 70 is illustrated in FIG. 5 and its frame structure is identical to that of the storm windows but merely has screen 72 replacing the acrylic window pane.

What is claimed is:

1. A combination storm window and security system comprising:

a house window frame opening having a rectangular configuration formed from a pair of laterally spaced vertically extending window frame members, a header connecting the top ends of said window frame members and a window sill connecting the bottom ends of said window frame members;

a rectangularly shaped aluminum window frame fixedly mounted in said window frame opening, said aluminum window frame having a pair of laterally spaced vertical channels connected at their bottom ends by a horizontal track channel, a sliding window panel mounted in said horizontal track channel, a stationary window panel laterally offset from said horizontal track channel and being rigidly secured to said aluminum window frame;

said window frame opening having an exterior side and an interior side, a pair of vertical sheet metal brackets offset toward the interior side of said window frame opening from said aluminum window frame, said vertical sheet metal brackets being rigidly attached to the respective vertically extending window frame members;

a vertical support member having its bottom end rigidly attached to the window sill and its top end rigidly attached to said header, said vertical support member being positioned approximately midway between said vertical sheet metal brackets;

a pair of storm windows having an exterior side and an interior side;

magnetic means for detachably securing said storm windows to said vertical sheet metal brackets and said vertical support members;

a wide gap magnetic switch having two separate components, the first one of said components being mounted on one of said storm windows adjacent one of its edges and the second of said components being located in said window frame, said second component being connected to a security alarm system; and said storm windows having a channel formed on their interior side along their bottom edge, said channel functioning as a fingergrip flange and also as a housing for supporting the first component of said wide gap magnet.

2. A combination storm window and security system as recited in claim 1 wherein said magnetic means are vertically oriented strip magnets that are attached to the exterior side of said storm windows and they mate with said vertical sheet metal brackets.

3. A combination storm window and security system as recited in claim 1 wherein said storm windows have acrylic plastic window panes.

* * * * *